US010525739B2

(12) United States Patent
Fort Filgueira et al.

(10) Patent No.: US 10,525,739 B2
(45) Date of Patent: Jan. 7, 2020

(54) CONTROLLING THE DISTRIBUTION OF PRE-HEATED AIR IN A PRINTING DEVICE

(71) Applicant: Hewlett-Packard Development Company, L.P., Houston, TX (US)

(72) Inventors: Aleix Fort Filgueira, Sant Cugat del Valles (ES); Simone Micheli, Sant Cugat del Valles (ES); Antonio Gracia Verdugo, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/079,524

(22) PCT Filed: Apr. 20, 2016

(86) PCT No.: PCT/EP2016/058776
§ 371 (c)(1),
(2) Date: Aug. 23, 2018

(87) PCT Pub. No.: WO2017/182072
PCT Pub. Date: Oct. 26, 2017

(65) Prior Publication Data
US 2019/0061377 A1 Feb. 28, 2019

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

| | | | | |
|---|---|---|---|---|
| 2003/0081098 | A1* | 5/2003 | Wotton | B41J 11/002 347/102 |
| 2009/0013553 | A1* | 1/2009 | Soltysiak | B41J 11/002 34/459 |
| 2014/0028767 | A1 | 1/2014 | Velasco et al. | |
| 2015/0000526 | A1 | 1/2015 | Tarrida Tirado et al. | |

FOREIGN PATENT DOCUMENTS

| | | |
|---|---|---|
| CN | 102673118 | 9/2012 |
| CN | 103481659 | 1/2014 |
| CN | 103818112 | 5/2014 |
| CN | 203651181 | 6/2014 |
| JP | 2014061690 | 4/2014 |

* cited by examiner

*Primary Examiner* — Lamson D Nguyen
(74) *Attorney, Agent, or Firm* — HP Inc. Patent Department

(57) ABSTRACT

In certain examples, a printing device comprises a print head, a dryer, a heat exchanger, a distribution system and a controller. The heat exchanger is coupled to an exhaust of the dryer to produce pre-heated air. The distribution system is coupled to the heat exchanger and a plurality of regions of the printing device. The controller causes the distribution system to distribute the pre-heated air from the heat exchanger among the plurality of regions based on an operating parameter of the printing device.

15 Claims, 4 Drawing Sheets

CONTROLLING THE DISTRIBUTION OF PRE-HEATED AIR IN A PRINTING DEVICE

BACKGROUND

In an example printing apparatus, printing fluid, such as ink, is deposited onto a print target by a print head. Example printing apparatus may include inkjet or latex printers. The printing apparatus may comprise at least one print head and each print head comprises nozzles from which ink droplets are ejected.

Ink may comprise a liquid component and a solid component such as a coloured pigment. During and after printing, heat may be applied to evaporate the liquid from print target on which the ink was deposited. The heat also helps fix the image onto the print target.

The generation of heat to apply during and after printing can result in high energy consumption.

BRIEF DESCRIPTION OF THE DRAWINGS

Various features will be apparent from the detailed description which follows, taken in conjunction with the accompanying drawings, which together illustrate, by way of example only, certain examples, and wherein.

DETAILED DESCRIPTION

Figure 1:
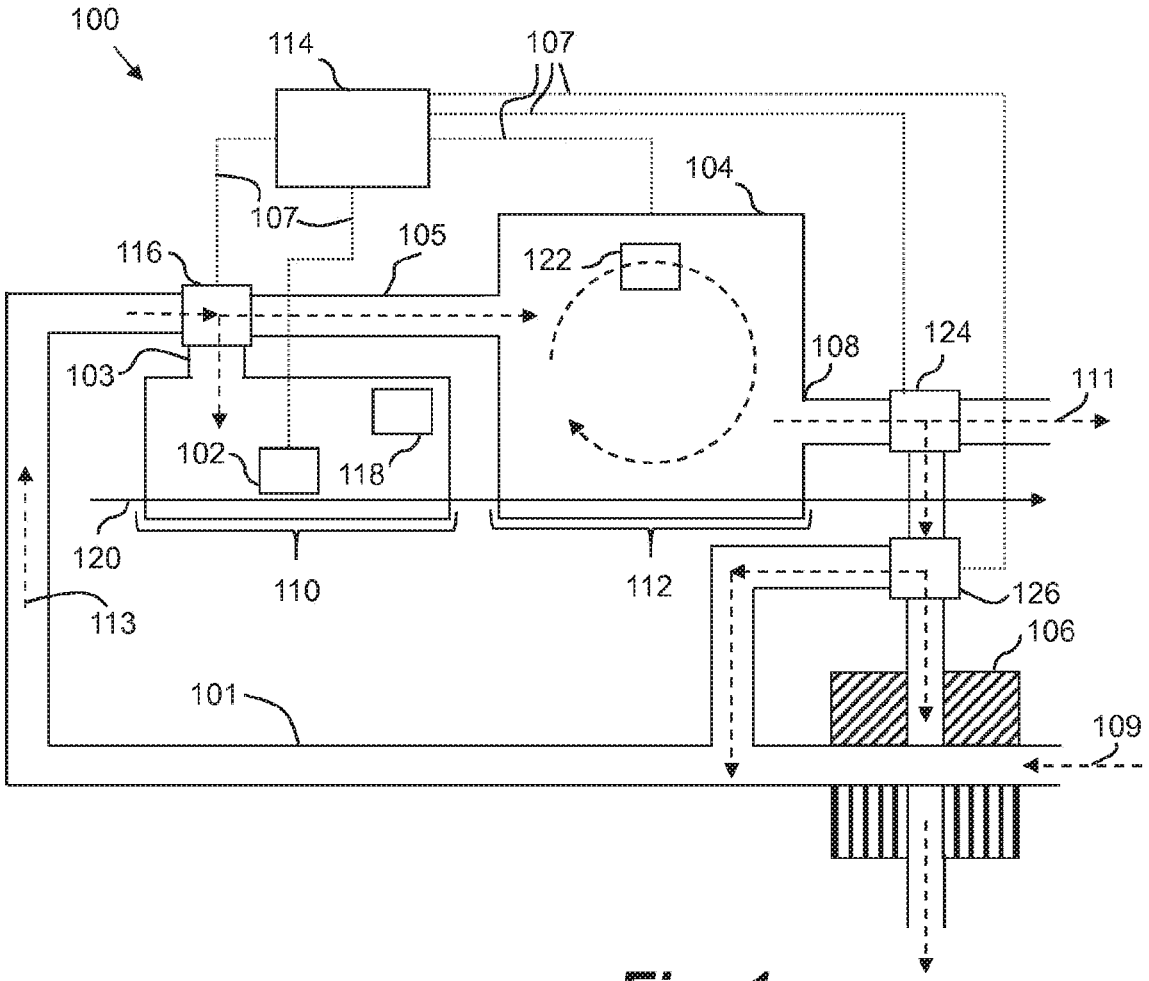
FIG. 1 is a diagrammatic representation of a printing device in accordance with an example.

In the following description, for purposes of explanation, numerous specific details are set forth in order to provide a thorough understanding of the present systems and methods. It will be apparent, however, that the present apparatus, systems and methods may be practiced without these specific details. Reference in the specification to "an example" or similar language means that a particular feature, structure, or characteristic described in connection with the example is included in at least that one example, but not necessarily in other examples.

As described herein, an example printing device comprises a print head, a dryer and a heat exchanger. The heat exchanger is coupled to an exhaust of the dryer to produce pre-heated air. The printing device further comprises a distribution system that is coupled to the heat exchanger and a plurality of regions of the printing device. A first region of the plurality of regions comprises the print head, and a second region of the plurality of regions comprises the dryer. The printing device further comprises a controller which causes the distribution system to distribute the pre-heated air from the heat exchanger among the plurality of regions based on an operating parameter of the printing device. For example, the pre-heated air may be distributed to one or both of the first and second regions. In another example, the distribution system may distribute pre-heated air to locations other than the plurality of regions, such as ejecting the pre-heated air outside of the printing device.

In one example the controller causes the distribution system to distribute the pre-heated air from the heat exchanger among the plurality of regions based on an operating parameter of the printing device. In some examples the controller is to further monitor the operating parameter of the printing device.

The heat exchanger can heat air, for example air at ambient temperature from outside of the printing device, using the heat contained within the exhaust gas expelled from the dryer. The pre-heated air is then distributed throughout the printing device to dry and/or cure printing fluid deposited onto a print target, for example ink deposited onto a printing medium. Pre-heating the air in this way reduces the energy used to heat the air to a pre-determined temperature. The pre-heated air may be dryer than the exhaust gas that contains solvents and liquids evaporated from the ink in the drying process.

The example printing device can direct or distribute the flow of pre-heated air among different regions of the printing device based on an operating parameter of the printing device. Example operating parameters may include a temperature of the print head, a future predicted temperature of the print head, a temperature of the first region comprising the print head, printing speed, a temperature of the dryer, a temperature of the second region comprising the dryer or an operation mode of the printing device. Controlling the distribution system on the basis of an operating parameter may allow control over the energy efficiency of the printing device, by controlling the pre-heated air to be directed into regions where desired (e.g., direct pre-heated air only to a particular region or subset of regions). Controlling the distribution system on the basis of an operating parameter may allow control over the image quality of the finished printed media. Controlling the distribution system on the basis of an operating parameter means that energy consumption may be reduced without detriment to the image quality.

FIG. 1 is a schematic diagram showing a printing device 100 in accordance with an example. The printing device 100 comprises a print head 102, a dryer 104, a heat exchanger 106 coupled to an exhaust 108 of the dryer, and a distribution system. The distribution system comprises pipes, ducts or conduits 101, 103, 105 and valve 116. The distribution system is coupled to the heat exchanger 106 and a plurality of regions of the printing device 100. A first region 110 of the plurality of regions comprises the print head 102. The first region 110 may also be called a print zone. A second region 112 of the plurality of regions comprises the dryer 104. The second region may also be called a curing zone or an impinging recirculation area. In the example in FIG. 1, the dryer 104 forms the second region 112. The print head 102 applies droplets of ink onto the print media 120 which passes through the first region 110 into the second region 112.

The printing device further comprises a controller 114 that causes the distribution system to distribute the pre-heated air from the heat exchanger 106 among the plurality of regions, based on an operating parameter of the printing device. In other examples, the controller 114 causes the distribution system to distribute the pre-heated air from the heat exchanger 106 among the plurality of regions, based on two or more operating parameters of the printing device.

The controller 114 is communicatively coupled to the distribution system via connections 107. Although depicted as direct connections, such as wires, in some examples the connections 107 may be indirect, such as via a data bus. These connections may receive and transmit signals. Five example wire connections are shown in FIG. 1: to the valve 116, print head 102, dryer 104, valve 124 and valve 126.

More or fewer connections to other elements of the printing device may be present in other examples.

The controller 114 may receive data via the connections 107. The received data may comprise an operating parameter of the printing device, or the controller may calculate the operating parameter based on the data. Furthermore, the controller 114, via the connections 107, can cause or instruct the distribution system to distribute the pre-heated air based on the operating parameter.

The controller 114 may comprise a feedback controller, for example a proportional-integral-derivative (PID) controller. The feedback controller may control the distribution system to maintain a predetermined set-point of an operating parameter, receiving a current value of the operating parameter as a feedback input.

In the printing device of FIG. 1, ambient air from outside of the printing device enters the heat exchanger 106. A first fan (not shown) may draw, or blow the air into and through the heat exchanger 106. Arrow 109 depicts the direction of flow of the cool air into the heat exchanger 106. As the ambient air flows through the heat exchanger 106, the ambient air is heated by hot exhaust air from the dryer 104. This hot air is expelled, or extracted from the exhaust 108 of the dryer 104 and can be diverted into the heat exchanger 106. A second fan (not shown) may draw or blow the hot air through the heat exchanger 106. In this example, the ambient air and hot exhaust air do not mix. Some of the hot air from the exhaust 108 of the dryer may also be expelled to the atmosphere and not provided to the heat exchanger, as depicted by arrow 111. In the heat exchanger 106, heat is transferred or flows from the hot exhaust gas to the cooler ambient air. The ambient air may now be considered to be warm air, or pre-heated air, because the ambient air has been heated by the exhaust air in the heat exchanger 106. The extent of the pre-heating may be controlled by varying the relative flow rates of the hot exhaust air and the ambient air through the heat-exchanger.

The pre-heated air flows through the distribution system via a conduit 101. Arrow 113 depicts the general direction of flow through the conduit. The pre-heated air flows towards the valve 116. Valve 116 is an electronically controlled 3-way valve in this example, so that the flow of warm air can be split between the first region 110 comprising the print head 102, and the second region 112 comprising the dryer 104. Valve 116 is controlled by the controller 114. The controller 114 may control the valve 116 to direct all of the pre-heated air into the first region 110 or all of the pre-heated air into the second region 112. In some examples, the controller 114 may control the valve 116 to direct a first portion of pre-heated air into the first region 110 and a second portion of the air into the second region 112. The first and second portions may be the same or different. The valve 116, being controlled by the controller 116, may therefore restrict or partially restrict the pre-heated air from flowing into the first and second regions 110, 112.

As the pre-heated air flows into the first region, the air may be further heated by the print zone heater 118. During operation of the printing device, the first region 110 may be maintained at a predetermined temperature. The energy consumption of the print zone heater 118 to maintain the predetermined temperature may be reduced because pre-heated air is supplied. In an example latex printing device, heating of the first region 110 removes liquid from the printing ink and fixes the image to the print media 120 closer to the print head 102. Furthermore, heating of the first region 110 may influence image quality by reducing coalescence and by decreasing deformation of the media 120.

The temperature of the print head 102 may affect the image quality. For example, if the temperature is not maintained at a constant value, colour shifts may occur. If the temperature of the print head is too high, damage to the print head and crusting may occur. It may therefore be desirable to maintain the print head temperature at a set-point. The set-point may be chosen to be below a safe operating temperature of the print head 102. Example set-point print head temperatures may be around 40, 50, 60, 70 or 80 degrees Celsius. In some examples the controller 114 may take the set-point into consideration when controlling the distribution of the pre-heated air. For example, if the temperature is above the set-point, the controller 114 may direct pre-heated air to a location other than the first region 110 to reduce the risk of damage to the print head 102. Directing pre-heated air to a location other than the first region may also impact on image quality, which may be reduced if the first region 110 is too hot.

The print head 102 and/or first region 110 may comprise a temperature sensor (not shown) which may be monitored by the controller 114. The temperature sensor may be a thermistor or thermocouple, for example. The current temperature of the print head and/or first region 110 may therefore be an operating parameter of the printing device, on the basis of which the controller causes the distribution system to distribute the pre-heated air among the plurality of regions, such as between the first region 110 and second region 112.

In some examples, the controller may predict a future temperature of the print head 102 based on at least the current print head temperature. The future predicted print head temperature may further be based on the future firing frequency of the print head 102. The firing frequency is the number of ink droplets that the print head 102 may deposit in future per unit time, for example in the next second, or in the next 2, 3, 4, 5 or 10 seconds. Therefore, the future predicted print head temperature may also be an operating parameter of the printing device, on the basis of which the controller causes the distribution system to distribute the pre-heated air among the plurality of regions, such as between the first region 110 and second region 112.

In an example, the temperature of the first region 110 and/or the print head may be determined from the operation of the printing device, without the use of a temperature sensor. For example, the temperature can be determined from known factors including print density and flow of pre-heated air previously supplied.

In an example, the print head temperature is monitored by the controller 114. The controller 114 may determine that the print head temperature is too high, or is rising rapidly. Responsive to this determination, the controller causes the distribution system to distribute the pre-heated air away from the first region 110 comprising the print head 102. For example, the controller 114 may control, or instruct the valve 116 to fully, or partially, restrict the flow of pre-heated air into the first region 110 so that no, or less, pre-heated air flows into the first region 110. In this way the print head temperature may return to a value below the safe temperature, or be maintained at a set-point temperature. In one example, the controller 114 controls the distribution system to reduce the distribution of the pre-heated air into the first region 110, for example the pre-heated air being distributed to the first region 110 may be reduced from a first proportion of the pre-heated air to a second proportion of the pre-heated air.

In another example, the controller may determine that the predicted future temperature of the print head 102 exceeds or is about to exceed a threshold. Responsive to this determination, the controller causes the distribution system to distribute the pre-heated air away from the first region 110 comprising the print head 102.

In a further example, the operating parameter of the printing device is an operation mode, or operating status, of the printing device. A printing device may have a plurality of operating modes including, for example a warm-up mode, an idle mode or a printing mode. When the operation mode of the printing device is a warm-up mode, it may be desirable to distribute all of the pre-heated air into the first region 110. This may help stabilize the temperature of the print media 120 and/or the print head 102. On the basis of the operating mode, the controller may cause the distribution system to direct the pre-heated air from the heat exchanger to the first region 110.

Returning back to FIG. 1, pre-heated air that does not enter the first region 110 flows through the valve 116 into the second region 112 and into the dryer 104. The dryer comprises a drying heater 122, for example an electric resistance heater, which further heats the pre-heated air. The second region 112 may be maintained at a desired temperature, therefore the energy consumption of the dryer heater 122 is reduced because the air has already been pre-heated. The dryer 104 may include fans and nozzles (not shown) for active circulation of the air within the dryer. In some examples, the circulation of the air within the dryer may be passive, for example by convection only. As the heated air circulates within the dryer 104, the proportion of liquid within the air may increase and the air can become saturated and less effective at drying. This saturated air is removed from the dryer 104 via the exhaust 108. The print media 120 emerges from the dryer with finished image upon it. In one example, a fan (not shown) may draw, or blow the saturated air out of the exhaust 108.

The heated air within the dryer 104 helps to evaporate any remaining liquid on the print media 120 and, in an example latex printer, may coalesce the latex. Heating the print media 120 in the second region 120 may ensure that the image is properly finished, for example to ensure that the ink does not smear and/or to ensure that the image is not wet. It may therefore be desirable to maintain the temperature of the dryer 104 at a set-point. Example set-point temperatures may be around 60, 70, 80, 90, 100, 110, 120 or 130 degrees Celsius. In an example latex printer, the set-point of the dryer temperature may be based on a desired curing profile of a latex ink, for example how quickly the ink is desired to dry. In some examples, the controller 114 may take this set-point into consideration when controlling the distribution of the pre-heated air. For example, the controller 114 may increase or decrease the flow of pre-heated air into the second region 112 in order to increase or decrease the temperature of the second region 112.

The dryer 104, or second region 112 may therefore comprise a temperature sensor which can be monitored by the controller 114. The current temperature of the dryer 104 and/or second region 112 may therefore be an operating parameter of the printing device, on the basis of which the controller causes the distribution system to distribute the pre-heated air among the plurality of regions, such as between the first region 110 and second region 112.

In an example, the dryer temperature is monitored by the controller 114. The controller 114 may determine that the dryer temperature is too high, or is rising rapidly. For example the dryer temperature may be above a set-point temperature, or the dryer temperature may, at the current rate of increase, go above the set-point temperature. Responsive to this determination, the controller causes the distribution system to distribute the pre-heated air away from the second region 112 comprising the dryer 104. For example, the controller 114 may control, or instruct the valve 116 to fully, or partially restrict the flow of pre-heated air into the second region 112 so that no, or less pre-heated air flows into the second region 112. In this way the dryer temperature may return to a value below the set-point temperature, or be maintained at the set-point temperature. In one example, the controller 114 controls the distribution system to increase the distribution of the pre-heated air into the second region 112, for example the pre-heated air being distributed to the second region 112 may be increased from a first proportion of the pre-heated air to a second proportion of the pre-heated air.

In a further example, the operating parameter of the printing device is an operation mode, or operating status, of the printing device. For example, the operation mode of the printing device may be a cool-down mode. In the cool-down mode it may be desirable to distribute all of the pre-heated air into the second region 112, because the print heads are no longer operating. On the basis of the operating mode, the controller may cause the distribution system to direct the pre-heated air from the heat exchanger 106 to the second region 112.

In another example, the pre-heated air flowing into the second region 112 may be reduced based on another operating parameter, for example an operating parameter associated with the first region 110. In one example, the controller 114 increases the proportion or flow rate of pre-heated air flowing into the second region 112 and reduces the proportion or flow rate of pre-heated air flowing into the first region 110 based on a temperature of the first region 110. In another example the controller 114 decreases the proportion or flow rate of pre-heated air flowing into the second region 112 and increases the proportion or flow rate of pre-heated air flowing into the first region 110 based on a temperature of the first region 110.

In some examples the controller 114 may prioritize one region in the plurality of regions above the other regions. For example the distribution of pre-heated air into the first region 110 may be prioritized above the distribution of pre-heated air into the second region 112.

In a further example, decreasing the flow rate of pre-heated air into one region of the plurality of regions does not responsively increase the flow rate of pre-heated air into another region of the plurality of regions. For example, should a decrease in the flow rate to the one region result in an overall reduction in the pre-heated air required for distribution among the regions, the flow rates within the heat exchanger could be adjusted to generate a lower flow rate of pre-heated air and/or to recover less heat from the exhaust.

On basis of the above, the controller 114 can control the distribution of pre-heated air based on an operating parameter of the printing device, for example based on predetermined energy consumption and/or image quality settings.

In the example printing device of FIG. 1, the printing device further comprises valve 124. The valve 124 may also be controlled by the controller 114. The valve directs the flow of exhaust air from the exhaust 108 of the dryer 104. The valve 124 can direct the exhaust air to be ejected from the printing device, can direct the exhaust air to flow towards the heat exchanger 106, or can direct a first portion of the exhaust air to be ejected and a second portion of the exhaust air to the heat exchanger 106. In some printing devices valve 124 may be omitted. In an example, valve 124 may be preset to direct a first percentage of exhaust air to be ejected and a second portion of the exhaust air to the heat exchanger.

In the example printing device of FIG. 1, the printing device further comprises valve 126. The valve 126 may also be controlled by the controller 114. The valve 126 controls the flow of exhaust air into the heat exchanger 106. The valve 126 can allow the exhaust air to flow into the heat exchanger 106 or to bypass the heat exchanger. The controller 114 may control the valve 126 to allow the exhaust air to bypass the heat exchanger 106 when the exhaust air is not saturated and so can be reused directly. The amount of liquid evaporated in the dryer 104 may be calculated based on the image that has previously been dried. For example a low coverage of ink on the image may mean less liquid has been evaporated in the dryer 104. If the amount of evaporation has been calculated to be low, the controller 114 may control the valve 126 to allow the exhaust gas to bypass the heat exchanger 106. In some examples, when the printing device is in warm-up mode, when no printing occurs, the controller 114 may allow all of the air to bypass the heat exchanger 106 when no evaporation-generating operations have taken place within a predetermined time (e.g., since power up or awaking from sleep mode). In some examples, the controller 114 may control the valve 126 on the basis of a sensed relative humidity of the exhaust gas, or a sensed solvent level in the exhaust gas. In some examples, valve 126 may be omitted.

In an example, fans may be provided associated with the valves 116, 124 and 126.

Figure 2:
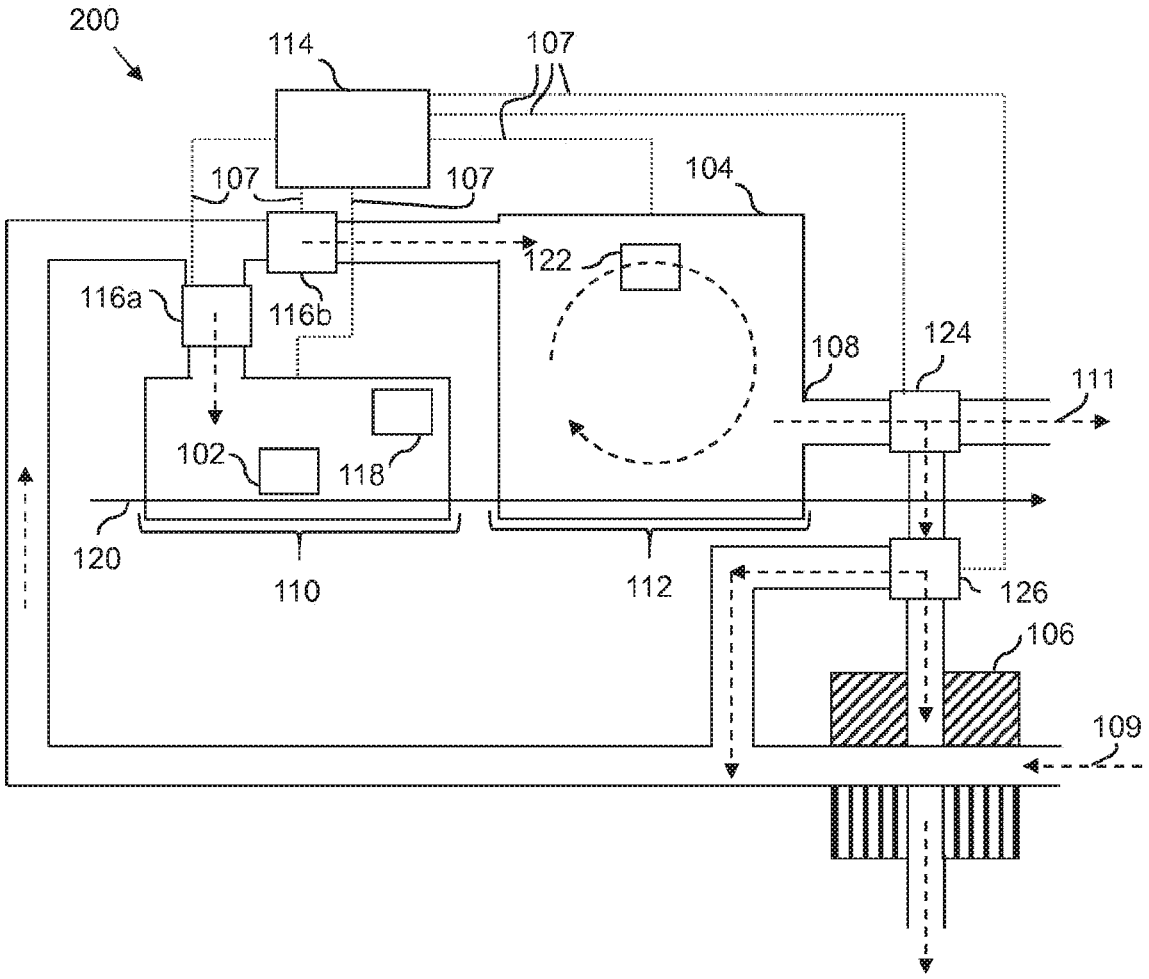
FIG. 2 is a diagrammatic representation of a printing device in accordance with another example.

FIG. 2 depicts another example printing device 200. The printing device 200 may be considered to be the same as printing device 100, except that the printing device 200 comprises two valves 116*a* and 116*b*, which are both controlled by the controller. In this example, the valves 116*a*, 116*b*, are 2-way valves, unlike the 3-way valve 116 in the example of FIG. 1. By controlling the relative opening of valves 116*a* and 116*b*, the controller 116 can therefore control the distribution of the pre-heated air among the plurality of regions.

Figure 3:
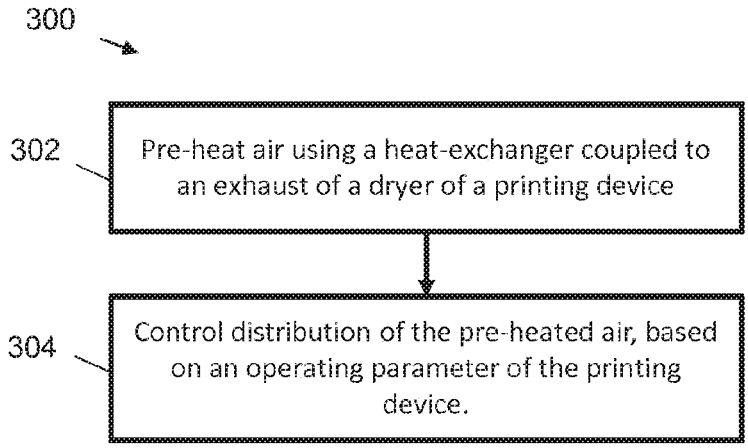
FIG. 3 is a flow diagram showing a method for controlling the distribution of pre-heated air in a printing device according to an example.

FIG. 3 is a flow diagram showing a method 300. The method can be performed by the example printing devices 100, 200 discussed in relation to FIGS. 1 and 2. At block 302, the method comprises pre-heating air using a heat-exchanger coupled to an exhaust of a dryer of a printing device. Pre-heated air is therefore generated. At block 304, the method comprises controlling distribution of the pre-heated air, based on an operating parameter of the printing device, to a plurality of regions of the printing device, the plurality of regions including a first region comprising a print head and a second region comprising the dryer.

In an example, the method may include monitoring the operating parameter of the printing device. For example, the operating parameter might be monitored to allow a feedback control system to be used.

The operating parameter may be a temperature of a print head of the printing device. In that case the method may further comprise determining that the temperature exceed a threshold. Responsive to the determination, the distribution of pre-heated air is adjusted to be away from the first region comprising the print head.

The operating parameter may be a temperature of the dryer. In that case the method may comprise determining that the temperature exceeds a threshold. Responsive to the determination, the distribution of pre-heated air is adjusted to be away from the second region comprising the dryer.

In an example, the controlling the distribution of the pre-heated air may be based on both the operating parameter and another operating parameter, so that the distribution is based on a first operating parameter and a second operating parameter. For example, the controlling the distribution may be based on both the operating parameter and another operating parameter, such as both a temperature of the print head and a temperature of the dryer. Other examples may control the distribution based on other combinations of operating parameters, for example including three or more operating parameters.

Certain system components and methods described herein may be implemented by way of non-transitory computer program code that is storable on a non-transitory storage medium. In some examples, the controller 114 may comprise a non-transitory computer readable storage medium comprising a set of computer-readable instructions stored thereon. The controller 114 may further comprise at least one processor. In some examples, control may be split or distributed between two or more controllers 114 which implement all or parts of the methods described herein.

Figure 4:
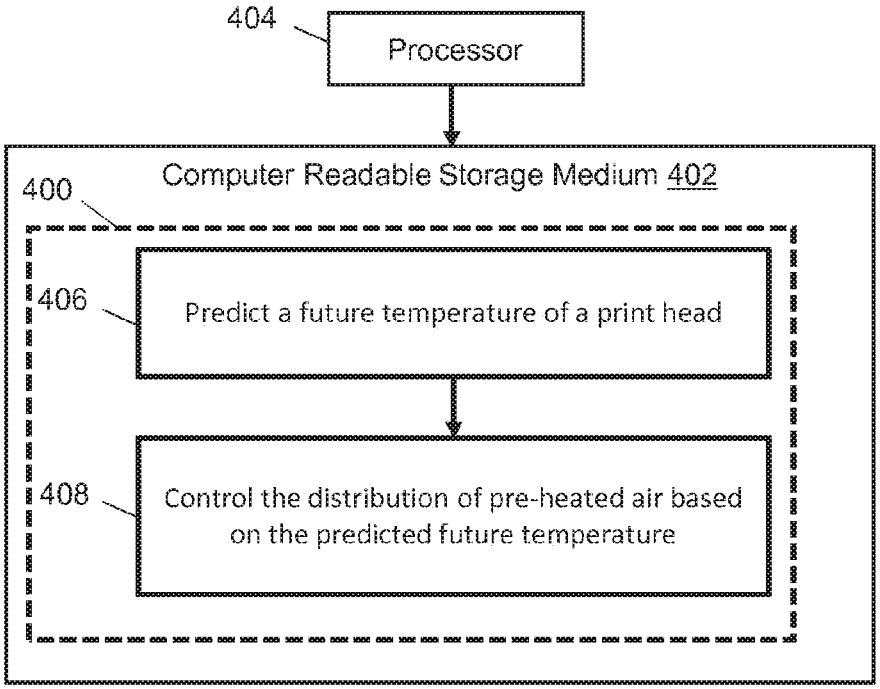
FIG. 4 is a diagrammatic representation of an example set of computer-readable instructions within a non-transitory computer-readable storage medium.

FIG. 4 shows an example of such a non-transitory computer-readable storage medium 402 comprising a set of computer readable instructions 400 which, when executed by at least one processor 404, cause the processor 404 to perform a method according to examples described herein. The computer readable instructions 400 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

In an example, instructions 400 cause the processor 404 in a printer to, at block 406 predict a future temperature of a print head. At block 408, the instructions 400 cause the processor 404 to control the distribution of pre-heated air based on the predicted future temperature. The pre-heated air is distributed between at least one of the first region comprising the print head and a second region comprising the dryer. The instructions may further cause the processor to determine that the predicted future temperature exceeds a threshold. Responsive to the determination, the distribution may be adjusted to distribute the pre-heated air away from the first region comprising the print head.

The invention claimed is:

1. A printing device comprising:
- a print head;
- a dryer;
- a heat exchanger coupled to an exhaust of the dryer to produce pre-heated air;
- a distribution system coupled to:
  - the heat exchanger;
  - a plurality of regions of the printing device, a first region of the plurality of regions comprising the print head, and a second region of the plurality of regions comprising the dryer; and
  - a controller to cause the distribution system to distribute the pre-heated air from the heat exchanger among the plurality of regions based on an operating parameter of the printing device.

2. The printing device of claim 1, wherein the controller is to monitor the operating parameter of the printing device.

3. The printing device of claim 1, wherein the operating parameter is a temperature of the print head.

4. The printing device of claim 3, wherein the temperature of the print head is a predicted future temperature of the print head.

5. The printing device of claim 1, wherein the operating parameter is a temperature of the dryer.

6. The printing device of claim 1, wherein the operating parameter is an operation mode of the printing device.

7. The printing device of claim 1, wherein the controller is to maintain the operating parameter at a set point.

8. The printing device of claim 7, wherein the set point is set based on at least one of:

a desired image quality; and a predetermined maximum print head operating temperature.

9. A method comprising:

pre-heating air using a heat-exchanger coupled to an exhaust of a dryer of a printing device, to generate pre-heated air; and based on a first operating parameter of the printing device, controlling distribution of the pre-heated air to a plurality of regions of the printing device, the plurality of regions including a first region comprising a print head, and a second region comprising the dryer.

10. The method of claim 9, further comprising monitoring the first operating parameter of the printing device.

11. The method of claim 9, wherein the first operating parameter is a temperature of the print head, the method further comprising:

determining that the temperature exceeds a threshold; and responsive to the determination, adjusting the distribution of the pre-heated air away from the first region comprising the print head.

12. The method of claim 9, wherein the first operating parameter is a temperature of the dryer, the method further comprising:

determining that the temperature exceeds a threshold; and responsive to the determination, adjusting the distribution of the pre-heated air away from the second region comprising the dryer.

13. The method of claim 9, wherein controlling the distribution of the pre-heated air is based on both the first operating parameter and a second operating parameter.

14. A non-transitory computer readable storage medium comprising a set of computer-readable instructions stored thereon, which, when executed by a processor, cause the processor to, in a printer:

predict a future temperature of a print head; and control the distribution of pre-heated air produced from a heat exchanger based on the predicted future temperature, wherein the heat exchanger is coupled to an exhaust of a dryer, and wherein the pre-heated air is distributed between at least one of a first region comprising the print head and a second region comprising the dryer.

15. The non-transitory computer readable storage medium of claim 14, wherein the instructions, when executed by the processor, further cause the processor to:

determine that the predicted future temperature exceeds a threshold, responsive to the determination, adjust the distribution of the pre-heated air away from the first region comprising the print head.

* * * * *